US005317751A

United States Patent [19]

Novakovich et al.

[11] Patent Number: 5,317,751

[45] Date of Patent: May 31, 1994

[54] METHOD AND APPARATUS FOR PLACING A TRAINLINE MONITOR SYSTEM IN A LAYUP MODE

[75] Inventors: Michael R. Novakovich, Pittsburgh; Richard D. Roberts, Elizabeth, both of Pa.

[73] Assignee: AEG Westinghouse Transportation Systems, Inc., Pittsburgh, Pa.

[21] Appl. No.: 853,251

[22] Filed: Mar. 18, 1992

[51] Int. Cl.[5] ..... G06F 1/26

[52] U.S. Cl. ..... 395/750; 364/424.01; 364/DIG. 1; 364/222.4; 364/230.4; 364/273.1

[58] Field of Search ..... 395/750, 200, 325; 364/424.01, 424.03

[56] References Cited

U.S. PATENT DOCUMENTS

| | | | |
|---|---|---|---|
| 4,131,941 | 12/1978 | Siegel et al. . | |
| 4,228,496 | 10/1980 | Katzman et al. . | |
| 4,312,035 | 1/1982 | Greene | 395/750 |
| 4,387,425 | 6/1983 | El-Gohary . | |
| 4,747,041 | 5/1988 | Engel et al. | 395/750 |
| 4,805,085 | 2/1989 | Mogi et al. . | |
| 4,819,149 | 4/1989 | Sanik et al. . | |
| 4,870,570 | 9/1989 | Satoh et al. . | |
| 4,894,828 | 1/1990 | Novy et al. . | |
| 4,987,317 | 1/1991 | Pournair et al. | 307/40 |
| 5,021,950 | 6/1991 | Nishikawa . | |
| 5,053,964 | 10/1991 | Mister et al. | 364/424.01 |

FOREIGN PATENT DOCUMENTS

| | | |
|---|---|---|
| 0327456 | 8/1989 | France . |
| WO91/01231 | 2/1991 | PCT Int'l Appl. . |

OTHER PUBLICATIONS

ISO 4335, Third Edition, "Information Processing Systems Data Communication-High-Level Data Link Control Elements of Procedures," International Organization for Standardization, Jan. 8, 1987.

Draft DIN 43322 German Standard Specification, Parts 1, 2, 4 and 5 dated Jun. 1988 and Part 3 dated Jul. 1988, Parts 1-5 in English and Part 3 in German also.

*Primary Examiner*—Debra A. Chun

*Attorney, Agent, or Firm*—Spencer, Frank & Schneider

[57] ABSTRACT

A method for placing a multi-car train with a communication network in an energy saving layup mode, the communication network having a master node interconnected to at least one other node via a train bus, the train having a head car for carrying the master node and at least one other car for carrying the at least one other node with an intelligent subsystem unit coupled to the train bus by the other node. The method includes transmitting a shutdown signal to the master node; sending in response to the shutdown signal a shutdown message from the master node to the at least one other node after a predetermined amount of time; and shutting down power to the intelligent subsystem unit in response to receiving the shutdown message at the at least one other node.

7 Claims, 3 Drawing Sheets

METHOD AND APPARATUS FOR PLACING A TRAINLINE MONITOR SYSTEM IN A LAYUP MODE

CROSS REFERENCE TO RELATED APPLICATIONS

This application is related to the following copending applications assigned to the same assignee as the present application which are hereby incorporate by reference:

U.S. Pat. application Ser. No. 07/686,927, entitled "PROPULSION CONTROL SYSTEM CENTRAL PROCESSING UNIT BOARD" filed Apr. 18, 1991, by William F. Molyneaux;

Ser. No. 08/029,348 which is a continuation of 07/853,250 now abandoned, Attorney Docket No. AWA-0376, by Michael R. Novakovich and Joseph S. Majewski, entitled "A METHOD AND APPARATUS FOR MONITORING AND SWITCHING OVER TO A BACK-UP BUS IN A REDUNDANT TRAINLINE MONITOR SYSTEM" filed Mar. 18, 1992;

Ser. No. 07/853,420, Attorney Docket No. AWA-0377, by Joseph S. Majewski, entitled "COLLISION HANDLING SYSTEM" filed Mar. 18, 1992;

Ser. No. 07/853,796, Attorney Docket No. AWA-0378, by Michael R. Novakovich and Joseph S. Majewski, entitled "A METHOD AND APPARATUS FOR CHRISTENING A TRAINLINE MONITOR SYSTEM" filed, Mar. 18, 1992;

Ser. No. 07/853,540 Attorney Docket No. AWA-0379, by Michael R. Novakovich and Richard D. Roberts, entitled "A METHOD AND APPARATUS FOR LOAD SHEDDING USING A TRAINLINE MONITOR SYSTEM" filed Mar. 18, 1992;

Ser. No. 07/853,960, Attorney Docket No. AWA-0380, by Michael R. Novakovich and Joseph S. Majewski, entitled "MULTI-MASTER RESOLUTION OF A SERIAL BUS" filed Mar. 18, 1992;

Ser. No. 07/853,251, Attorney Docket No. AWA-0383, by Henry J. Wesling, Michael R. Novakovich and Richard D. Roberts, entitled "REAL-TIME REMOTE SIGNAL MONITORING" filed Mar. 18, 1992;

Ser. No. 07/853,403, Attorney Docket No. AWA-0391, by William F. Molyneaux, entitled "COMMUNICATIONS CONTROLLER CENTRAL PROCESSING UNIT BOARD" filed Mar. 18, 1992;

Ser. No. 07/853,204, Attorney Docket No. AWA-0394, by Henry J. Wesling, Michael R. Novakovich and Richard D. Roberts, entitled "DISTRIBUTED PTU INTERFACE" filed Mar. 18, 1992.

BACKGROUND OF THE INVENTION

1. Field of the Invention

This invention relates generally to a communication network and in particular to providing a trainline monitor layup mode on a point-to-point communication network for a train.

2. Description of the Related Art

A train communication system developed by the assignee of the present application, based on the proposed European specification DIN 43322 for "Serial Interfaces to Programmable Electronic Equipment for Rail Vehicles," incorporated herein by reference, enables a master node located typically in a head car of a train to communicate via a serial bus to slave nodes on middle cars of the train and on a tail car of the train. See also, "International Standard-Information processing systems-Data communication-High-level data link control elements of procedures, ISO 4335", Third edition, Global Engineering Documents, Irvine, CA, 1987, the subject matter of which is also incorporated herein by reference.

The DIN 43322 using the ISO 4335 Standard provides for a train bus master to broadcast a "disconnect" command which completely shuts down a train bus by disconnecting the train bus from train bus slaves and the train bus master whenever that train bus master is keyed off by an operator. However, once the train bus is disabled, no communication can take place between the train bus master and the train bus slaves. Hence, once the train bus master is keyed off, the entire trainline monitor (TLM) system is disabled and no diagnostic or control information can be transmitted between the train bus master and a train bus slave.

This becomes particularly disadvantageous if the operator in the master car, i.e., the car which carries the train bus master, leaves that car unattended for only a short period of time, or if other maintenance personnel or cleaning personnel wish to activate auxiliary systems such as lights, air conditioning, heating or ventilation on any slave car, i.e., cars which carry train bus slaves, while the master car and consequently the train bus master is disconnected. In such cases, it would be desirable to provide a layup mode of operation in order to keep the auxiliary systems running for a finite period of time before completely shutting down the trainline system. This would both reduce wasted energy, and allow the maintenance and cleaning personnel to work in comfortable conditions rather than uncomfortably hot or cold conditions.

A problem that must be addressed in providing a layup mode occurs when a new train, or a new single car or a new group of cars are added to an original train while the train is in a layup mode. That is, since the train bus for the original train's trainline monitor system has not been disabled, a resultant trainline monitor system (comprising the original trainline monitor system and the newly added node) will likely have multiple train bus masters (master nodes). Hence, in order to provide a layup mode, the trainline monitor system for the resulting train must be capable of resolving multiple train bus masters to yield a single resultant train bus master for the resultant trainline monitor system problem while continuing to supply energy to all the cars on the resultant train.

SUMMARY OF THE INVENTION

An object of the invention therefore is to provide a method and apparatus for placing a trainline monitor system in a layup mode thereby maintaining sufficient communications between a train bus master and train bus slaves on a trainline monitor system after an operator in a car containing the train bus master keys off his console. This must be possible even when a new car or a new train is connected to the original train resulting in multiple train bus masters. The layup mode must also function when cars are eliminated from the original train during layup.

An advantage of the layup mode according to the invention is that it saves energy because power can still be transmitted from car to car on the train for a finite predetermined amount of time regardless of whether the train is modified by adding or subtracting cars, or coupling a new train to the original train.

Another advantage of the invention is that it enables maintenance and cleaning personnel to work in a comfortable environment whenever the trainline monitor system is in the layup mode even though new cars are being added to the original train or original cars are being taken from the original train.

The above and other objects, advantages and features are accomplished in accordance with the invention by the provision of a method for placing a multi-car train with a communication network in an energy saving layup mode, the communication network having a master node interconnected to at least one other node via a train bus, the train having a head car for carrying the master node and at least one other car for carrying the at least one other node with an intelligent subsystem unit coupled to the train bus by the other node, including the steps of: transmitting a shutdown signal to the master node; sending in response to the shutdown signal a shutdown message from the master node to the at least one other node after a predetermined amount of time; and shutting down power to the intelligent subsystem unit in response to receiving the shutdown message at the at least one other node.

According to another aspect of the invention, there is provided the method for placing a multi-car train with a communication network in an energy saving layup mode, wherein the communications network comprises a master/slave communications network and the one other node is a slave node responsive to the master node, further including the steps of: forming a resultant train by adding a further car to the train containing a second master node and connecting the second master node to the master/slave communications network, the second master node being capable of controlling all slave nodes in the other cars; and relinquishing control of the slave nodes from the first master node to the second master node.

According to another aspect of the invention, there is provided an apparatus for laying up a trainline monitor system for a train including at least a head car and an other car, including: a master node on the head car of the train; a slave node on the other car of the train; a train bus for interconnecting the master node with the slave node; intelligent subsystem means on the other car of the train and coupled to the slave node for providing comfortable conditions in the other car; a console having a switch and coupled to the master node, whereby keying off the switch causes the console to send a signal to the master node, the master node in response to the signal sending after a predetermined amount of time a message to the slave node which causes the intelligent subsystem to shut down.

According to another aspect of the invention, there is provided an apparatus for laying up a trainline monitor system for a train, the trainline monitor system having a master node interconnected to at least one other node via a train bus and having a console coupled to the master node, the train having a head car for carrying the master node and at least one other car for carrying the at least one other node and for carrying an intelligent subsystem unit including at least one of a heating unit, an air conditioning unit, a ventilation unit and a lighting unit, coupled to the train bus by the other at least one other node, including: a console having a switch for keying off; shutdown signal output means coupled to the console for outputting after a predetermined amount of time a shutdown signal in response to keying off the console; and shutting down means coupled to the shutdown signal output means for receiving the shutdown signal and for shutting down power to the intelligent subsystem in accordance therewith

DETAILED DESCRIPTION OF PREFERRED EMBODIMENTS

Figure 1:
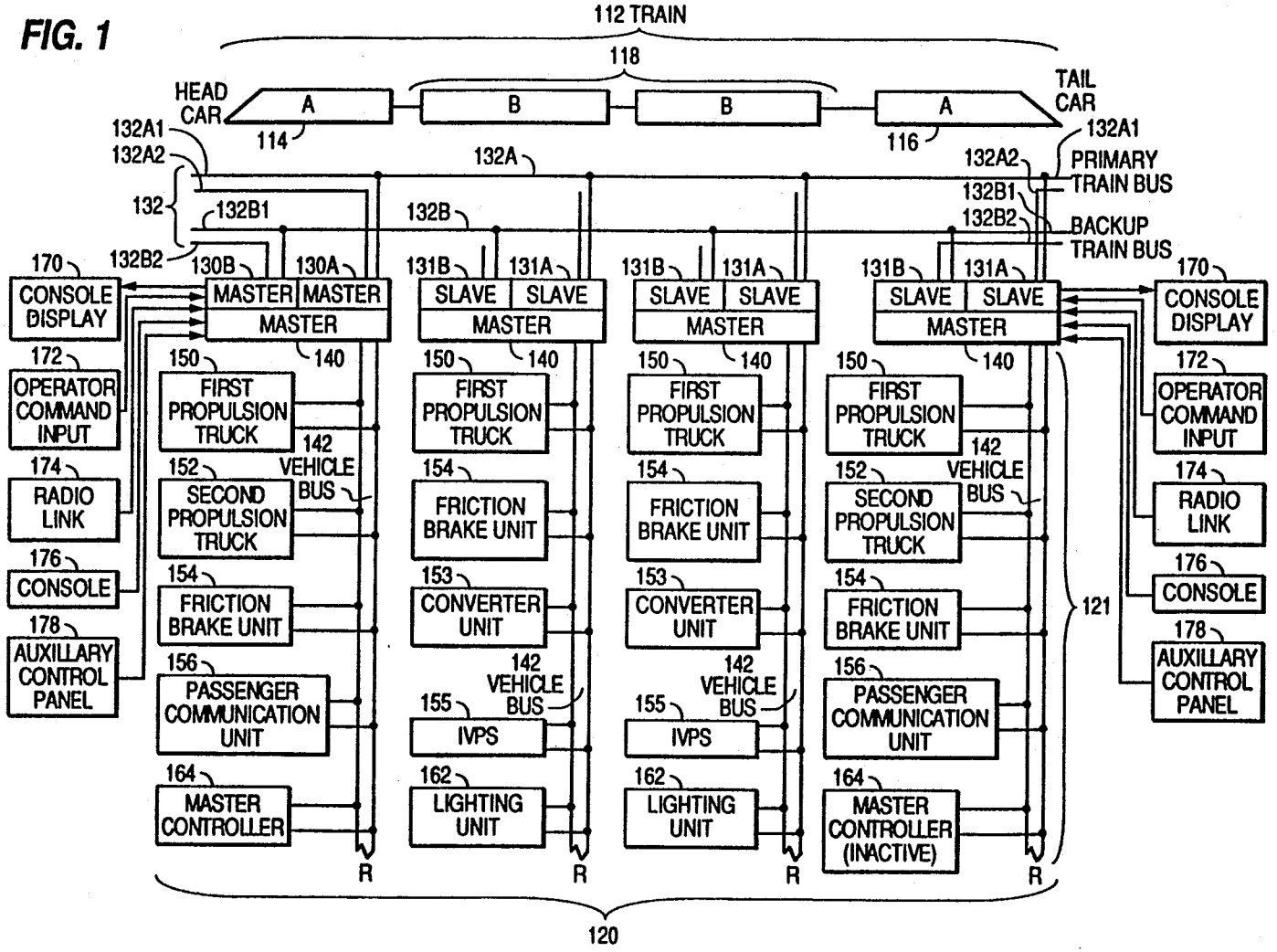
FIG. 1 is a schematic view of a train and its associated trainline monitor (TLM) system in which the present invention finds particular usefulness.

Referring now to FIG. 1 shown is a Trainline Monitor (TLM) System 120 in which the invention finds particular use. FIG. 1 shows a representative train 112 with a head car 114, a tail car 116, and middle cars 118. Only two middle cars 118 are shown; however, a typical commuter train may have from one to ten middle cars 118 having essentially the same equipment on board.

Head car 114 has redundant train bus masters including primary train bus master 130A and backup train bus master 130B as shown. Primary train bus master 130A serves as a master node for primary train bus 132A and backup train bus master 130B serves as a master node for backup train bus 132B. primary train bus 132A and backup train bus 132B make up redundant train buses 132. In addition, middle cars 118 and tail car 116 each have redundant train bus slaves including primary train bus slave 131A and backup train bus slave 131B.

Primary train bus 132A has a main channel 132A1 and an auxiliary channel 132A2. Similarly, back-up train bus 132B has a main channel 132B1 and an auxiliary channel 132B2. Unless otherwise indicated, communications on primary train bus 132A take place on main channel 132A1 and communications on back-up train bus 132B take place on main channel 132B1. Communications on auxiliary channels 132A2 and 132B2 only occur when primary train bus slave 132A and back-up train bus slave 132B are on a tail car 116 as discussed for example in commonly, owned and concurrently filed U.S. Pat. application No. 07/853,796 entitled "A Method and Apparatus For Christening A Trainline Monitor System."

Each car 114, 116 and 118 has a vehicle bus master 140 with a vehicle bus 142. As used herein, trainline monitor system (TLM) 120 is intended to comprehend redundant train bus masters 130, redundant train bus slaves 131, redundant train buses 132, vehicle masters 140, vehicle buses 142 and intelligent subsystem interfaces (not separately shown) to vehicle buses 142 discussed below.

TLM system 120 is used to interconnect the various subsystems. Examples of subsystems which may be found on head car 114 include first propulsion truck 150, second propulsion truck 152, friction brake unit 154, passenger communication unit 156 and master controller 164 for controlling first and second propulsion trucks 150, 152 and friction brake unit 154. Other subsystems may include a door control unit (not shown), a heating, ventilation and/or air conditioning unit (HVAC) 160 , a lighting unit 162, etc. Status information about the vehicle subsystems is requested, furnished and displayed.

Middle cars 118 can have the same subsystems as head car 114 but they typically would not have a second propulsion truck 152 or master controller 164 but instead would have a convertor unit 153 and an intermediate voltage power supply (IVPS) 155. Tail car 116 has the same subsystems as head car 114 but with an inactive master controller 164. The following discussion regarding train bus master 130A applies to train bus master 130B as well.

Head car 114 has, in addition to redundant train bus masters 130A and 130B, a console display 170, operator command input unit 172, radio link unit 174, console 176 having a switch 176A whose position is read by vehicle bus master 142. Auxiliary control panel 178 facilitates control and communications by a train operator.

Vehicle bus master 140 with redundant train bus masters 130A, 130B or redundant train bus slaves 131A, 131B can be embodied in three separate central processing units (CPUs) or a single CPU with a multitasking operating system and 3 separate I/O ports. Each of the train buses 132A and 132B, with its master and slave devices, are preferably configured as a high-level data link control (HDLC) packet communications network.

Referring to head car 114, vehicle bus master 140 communicates with one of redundant train bus masters 130A and 130B which in turn communicate with the rest of TLM system 120 via one of the primary train bus 132A and backup train bus 132B, respectively. Vehicle bus 142 has predetermined nodes and therefore does not have to deal with such considerations as geographic addressing or car orientation.

Vehicle bus master 140 and the various subsystems 150–156, etc., operate under standard master-slave communications protocols, such as Synchronous Data Link Control (SDLC), using a multidrop RS-485 serial link. Vehicle bus master 140, vehicle bus 142 and the various vehicle subsystems comprise a master-slave communication subsystem 121.

Each vehicle bus 142 is based on the well known industry standard Intel BITBUS, the subject matter of which is hereby incorporated by reference. This provides a simple, expandable system to which all systems on the vehicle can easily interface. BITBUS messages are transmitted as synchronous data link control (SDLC) data packets. During operation, the SDLC-encoded messages and protocol ensure data integrity and provide a way to request data retransmission if necessary. Communications on TLM system 120 provide information to an operator of the vehicle about particular subsystems on the various vehicles of train 112.

TLM system 120 is connected to first and second propulsion trucks 150 and 152 by vehicle bus 142. The TLM system 120 can transmit test commands, propulsion commands, real-time clock synchronization information, etc., to the first and second propulsion trucks 150 and 152. First and second propulsion trucks 150 and 152 respond by transmitting back test results and status information over the TLM system 120.

In a like manner, TLM system 120 is connected to convertor unit 153 by vehicle bus 142. TLM system 120 can transmit test commands and convertor control commands such as convertor on/off, load shedding commands and real-time clock synchronization information, etc., to convertor unit 153. Convertor unit 153 responds by transmitting back test results and status information to TLM system 120.

TLM system 120 is connected to a friction brake unit 154 by vehicle bus 142. TLM system 120 transmits test commands, braking commands and real-time clock synchronization information, etc., to friction brake unit 154. Friction brake unit 154 responds by transmitting back test results and status information to TLM system 120.

TLM system 120 is also connected to intermediate voltage power supply (IVPS) 155 and passenger communication unit 156 by vehicle bus 142. IVPS converts 600 volt power into 300 volts which is necessary since some of the subsystems, such as friction brake unit 154, use 300 volt power. TLM system 120 transmits test commands, IVPS control commands, such as IVPS on/off commands, and real-time clock synchronization information, etc., to IVPS 155 and IVPS 155 responds by transmitting back test results and status information to TLM system 120. TLM system 120 transmits test commands, real-time clock synchronization information, car serial number, relative car position, car orientation information, zero speed commands, door open and close commands, and odometer or speed signals, etc., to passenger communication unit 156. Passenger communication unit 156 responds by transmitting back test results and status information to TLM system 120.

TLM system 120 is also connected to other subsystems such as a door control unit (not shown), a heating, ventilation and/or air conditioning (HVAC) unit 160, and a lighting unit 162, by vehicle bus 142. TLM system 120 transmits test commands, status requests, real-time clock synchronization information, car orientation information, etc., to these units which respond by transmitting back test results and status information.

Operator command input unit 172 of head car 114 may be a waterproof piezo keyboard having piezo keys integrated into a 5 mm aluminum plate and operated through a 0.8 mm aluminum cover plate. Console display 170 may be an electro-luminescent self-illuminated screen. Console 176 is a state driven device having a "power-up" state and an "operating" state.

If a car in train 112 is keyed-up, then operator console 176 is enabled and this car becomes the head car with redundant train bus masters 130A, 130B. At start-up, console display 170 displays results of power-up self-test. Then, TLM system 120 enters an "operating state." Console display 170 then displays a simple status message (OK, Warning, Failed or Non-existent) for each subsystem 150–164 on each car of train 112. The operator can use operator command input 172 to access diagnostic information on any of the subsystems 121 on any of the cars of train 112.

Information can also be transmitted or received by a wayside station using radio link 174 thereby reporting diagnostic alarms and acting as a diagnostic data dump at a specific point along the wayside.

In TLM 120 system shown in FIG. 1 in which the invention has particular usefulness, redundant train buses 132 are based on the aforementioned DIN 43322 specification developed especially for the railroad environment. It is configured as a master-slave communication system that uses a multi-drop RS-485 serial link. The serial data is Manchester encoded for higher reliability. This also allows it to pass through the galvanic isolation between cars. Train bus messages between vehicles are encoded into standard high level data link control (HDLC) data packets as described in the aforementioned ISO 4335 . During operation, the HDLC-encoded messages and protocol ensure data integrity and provide a way to request data retransmission if necessary.

The trainline monitor layup mode according to the invention will now be described with reference to TLM system 120. Here it is assumed that primary train bus master 130A, primary train bus slaves 131A and primary train bus 132A are all active. However, this discussion holds if backup train bus master 130B, back-up train bus slaves 131B and back-up train bus 132B are substituted for their respective primary components.

When the operator in head car 114 stops train 112 and keys off his console 176, primary train bus master 130A broadcasts an "Enter Layup Mode" message (rather than an "Enter Disconnect Mode" message which is an ISO 4335 command used in the DIN 43322 to disconnect slave nodes from a master node on a trainline monitor system as discussed in "Serial Interfaces to Programmable Electronic Equipment for Rail Vehicles", Part 3, June, 1988) to the primary train bus slaves 131A via primary train bus 132A of TLM system 120. Primary train bus master 130A continues to service primary train bus slaves 131A with certain layup functions in layup mode. These functions may include providing power for lighting unit 162 and heating ventilation and/or air conditioning (HVAC) unit 160 while subsystems such as first and second propulsion tracks 150 and 152 are shutdown. These functions continue to operate for a predetermined period of time (say 15 minutes) after the operator keys off his console 176 at which point the primary train bus master 130A sends an HDLC message to all of primary train bus slaves 131A telling them to shutdown (e.g., shut off lights). Throughout this time, TLM system 120 remains powered up. Consequently, if a cleaning or maintenance personnel enter one of middle cars 118 or tail car 114 and turn on the lights, the respective primary train bus slave 131A sends a message to primary train bus master 130A which again waits the predetermined length of time and then sends an HDLC message to primary train bus slave 131A telling it to turn off the lights.

If during layup mode, any other operators' console (not shown) is keyed up, a new primary train bus master transmits a "Relinquish Mastership" request (which is a DIN 43322 message for requesting a master node to cease in functioning as a master node and instead function as a slave node on the trainline monitor system also discussed in "Serial Interfaces to Programmable Electronic Equipment for Rail Vehicles, Part 3") to original primary train bus master 130A. Original primary train bus master 130A then sends an "Enter Disconnect Mode" message so that original primary train bus slaves 131A are disconnected from original primary trainline bus 132A and can thus be christened as part of resultant trainline monitor system (christening is discussed in concurrently filed and commonly assigned U.S. Pat. application No. ***, entitled "A Method and Apparatus For Christening a Trainline Monitor System"). If the "Enter Disconnect Mode" and "Relinquish Mastership" messages proceed without error, the new primary train bus master takes control of the TLM system.

Figure 2:
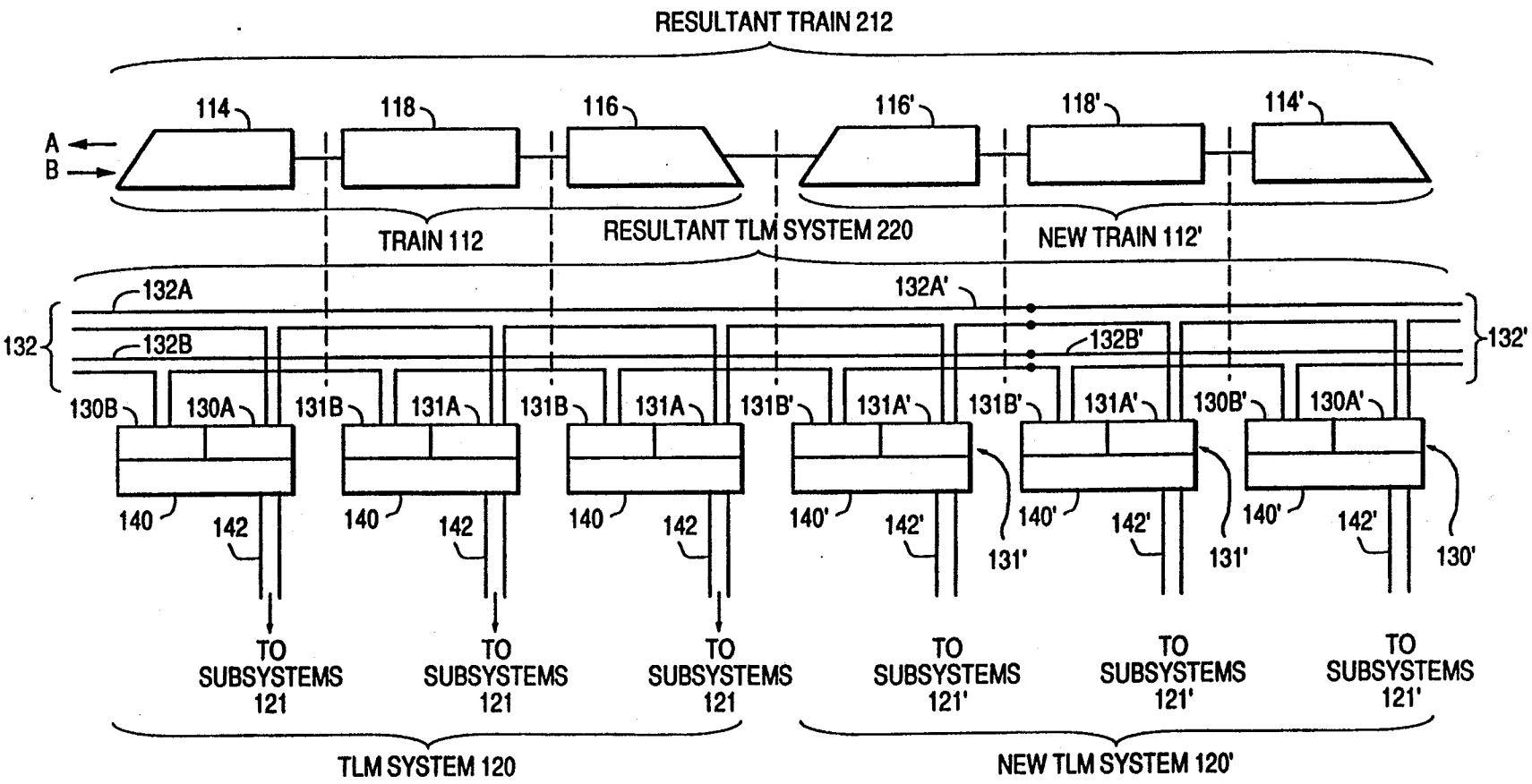
FIG. 2 is a schematic diagram of a resultant train which includes an original train and a new train and which has a resultant TLM system.

FIG. 2 shows train 112 (original train) connected to new train 112' at tail car 116 and new head car 114'. New head car 114', carries new redundant train bus masters 130', i.e., primary train bus master 130A' and backup train bus master 130B'. New middle cars 118' carry new redundant train bus slaves 131', i.e., new primary train bus slave 131A' and new backup train bus slave 131B'. Finally, new tail car 116' carries new redundant train bus slaves 131', and an inactive master controller 164'.

Original train 112 and new train 112' together comprise a resultant train 212 which can travel in either direction A or direction B of FIG. 2. Also, TLM system 120 of train 112 is interconnected to new TLM system 120' yielding a resultant TLM system 220 as shown in FIG. 2. If resultant train 212 travels in direction A, new primary train bus master 130A' on new head car 114' should relinquish mastership to primary train bus master 130A on head car 114. On the other hand, if resultant train 212 is to travel in direction B, then primary train bus master 130A on head car 114 should relinquish mastership to new primary train bus master 130A' on new head car 116'.

Figure 3:
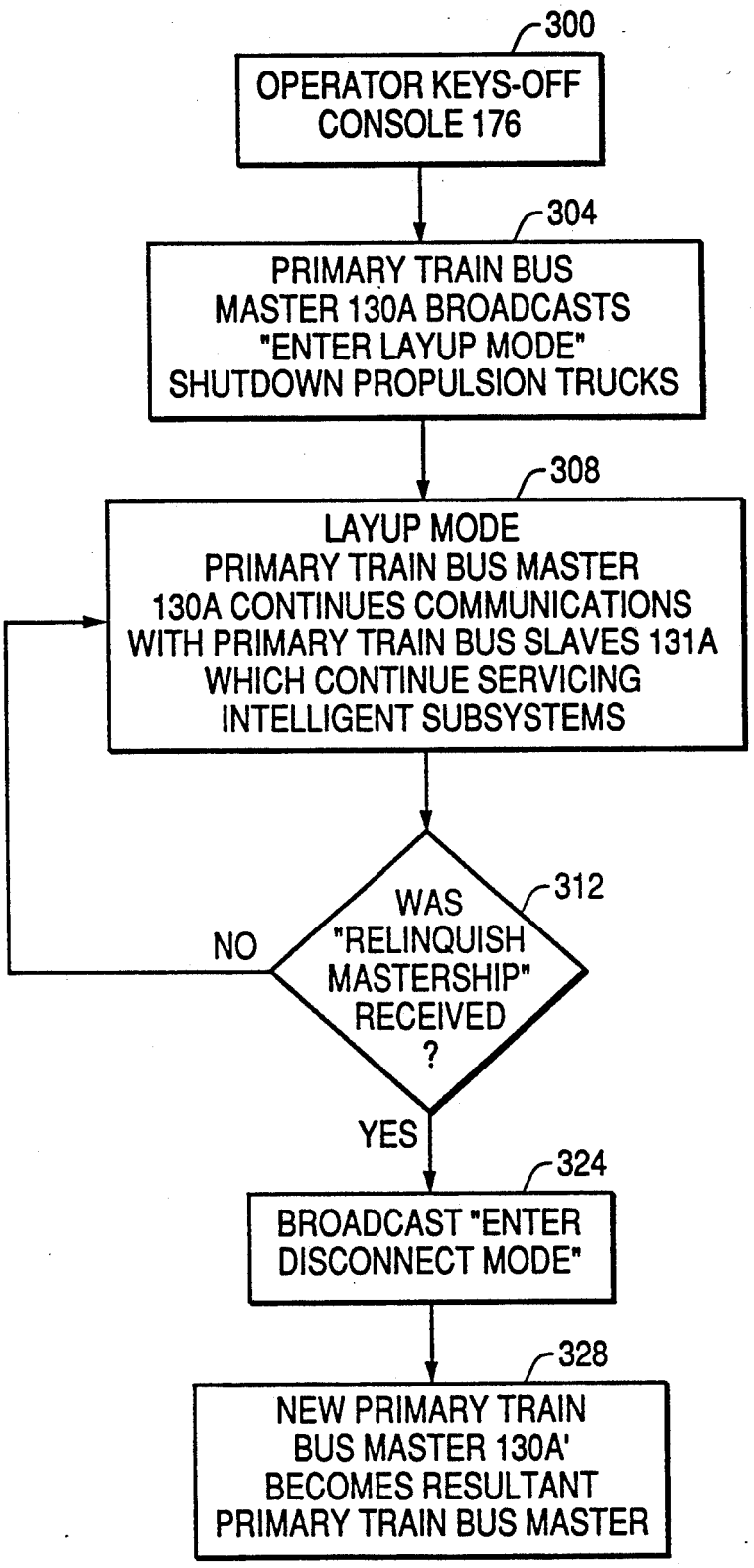
FIG. 3 is a flow chart showing the steps involved in maintaining a trainline monitor system in a layup mode according to an embodiment of the invention.

The resolution of the plural train bus masters on resultant TLM system 220 is accomplished in accordance with the steps shown in FIG. 3. Namely, the operator keys off console 176 of primary train bus master 130A at step 300. However, instead of entering a "Disconnect Mode" in accordance with DIN 43322 , TLM system 120 via primary train bus master 130A broadcasts an "Enter Layup Mode" message on primary train bus 132A to primary train bus slaves 131A which in turn shutdown propulsion trucks 150, 152 at step 304. The enter layup mode command will be sent as a standard HDLC I frame. It will use the following octets (bytes) for the message, ignoring HDLC I frame overhead EA 00 00 20 00. The patterns shown are in hexadecimal. The EA is the master's address The 00's in the middle are reserved for the transport layer and would be non-zero if the message was larger than one packet. The 20 00 is the actual command to enter layup mode. TLM system 120 enters into the layup mode at step 304. Namely, primary train bus master 130A continues communications with primary train bus slaves 131A which in turn continue servicing subsystems such as HVAC units 160 and/or lighting units 162 at step 308. Also, vehicle masters 140 coupled to vehicle buses 142 comprise a shut down unit 151 for shutting down respective subsystems after receiving commands from primary train bus master 130A such as, for example, HVAC unit 160 and lighting unit 162 after a predetermined amount of time, e.g., 15 minutes, has passed. Hence, while TLM system 220 remains in a layup mode, HVAC subsystem 160 and lighting unit 162 continue to have power for the predetermined amount of time so that maintenance and cleaning personnel can work in comfortable conditions for the predetermined amount of time.

Once train bus 132A is in layup mode, primary train bus master 130A and slave 131A at either end of train 112 are looking for a new train to be attached to existing train 112 by listening for a christening message to be received on auxiliary channel 132A2 of primary train bus 132A. They are also looking for their respective operator's consoles to be keyed up. If either of these things happen on tail car 116, it will send the "relinquish mastership" message, and primary train bus master 130A will respond by broadcasting the "Enter Disconnect Mode" message. If either of these things happen on head car 114, it automatically broadcasts the "Enter Disconnect Mode" message. Namely, once TLM system 120 is in the layup mode at step 308, primary train bus slave 131A on tail car 116 repeatedly checks auxiliary channel 131A2 on primary train bus 132 to determine whether or not new primary train bus master 130A' or new TLM system 120' has been connected to TLM system 120 at step 312. If new primary train bus master 130A' has been connected to TLM system 120, it transmits a "Relinquish Mastership" on primary train bus 132A in accordance with DIN 43322. In response to the "Relinquish Mastership" message, primary train bus master 130A broadcasts an "Enter Disconnect Mode" on primary train bus 132A to its primary train bus slaves 131A at step 324. New primary train bus master 130A' then becomes a resultant primary train bus master and begins to christen for resultant TLM system 220 car by car at step 328.

Obviously, numerous and additional modifications and variations of the present invention are possible in light of the above teachings It is therefore to be understood that within the scope of the appended claims, the invention may be practiced otherwise than as specifically claimed.

What is claimed is:

1. A method for placing a multi-car train with a communication network in an energy saving layup mode, the communication network having a master node interconnected to at least one node via a train bus, the train having a head car for carrying the master node and at least one other car for carrying the at least one other node with an intelligent subsystem unit coupled to the train bus by the other node, the intelligent subsystem unit controlling auxiliary systems of the at least one other car, the head car including an operator console for controlling the train through the master node, the method comprising the steps of:

transmitting a shutdown signal from the operator console to the master node to disable operation of the train;

sending in response to the shutdown signal an shutdown message from the master node to the at least one other node after a delay of a predetermined amount of time, the train being in a layup mode during the predetermined amount of time wherein the train is not operational but auxiliary systems controlled by the intelligent subsystem unit of the train are kept running; and subsequently shutting down power to the intelligent subsystem unit with the at least one other node in response to receiving the shutdown message at the at least one other node after the expiration of the predetermined amount of time.

2. A method as claimed in claim 1, wherein the communications network comprises a master/slave communications network and the at least one other node is a slave node responsive to the master node, the method further comprising the steps of:

when a further car containing a second master node able to control any slave node in any car is coupled to the train during the predetermined time that the train is in the layup mode, forming a resultant train by establishing communication between the second master node and the master/slave communications network; and relinquishing control of any and all slave nodes from the first master node to the second master node.

3. The method as claimed in claim 1, wherein the communication network has a plurality of other nodes and respective intelligent subsystem units, wherein said second step further comprises sending, in response to the shutdown signal, shutdown messages to the plurality of other nodes after said delay of a predetermined amount of time, and wherein said shutting down step further comprises shutting down power to the plurality of intelligent subsystem unit by the respective other nodes in response to receiving the shutdown messages.

4. An apparatus for placing a muilti-car train with a communication network in an energy saving layup mode, the train including at least a head car and at least one other car, comprising;

a master node on the head car of the train;

a slave node on the at least one other car of the train;

a train bus interconnecting said master node with said slave node;

intelligent subsystem means on the at least one other car of the train and coupled to said slave node for controlling auxiliary systems for providing comfortable conditions in the at least one other car; and an operator console having a switch and coupled to said master node, wherein said console includes means for sending a signal to the master node, whereby keying off said switch causes the console to send the signal to said master node, wherein said master node includes means for sending a message to said slave node in response to the signal after a delay of a predetermined amount of time, the train being in a layup mode during the predetermined amount of time wherein the train is not operational but the auxiliary systems controlled by the intelligent subsystem of the train are kept running, said message to said slave node causing said intelligent subsystem to shut down.

5. An apparatus for laying up a trainline monitor system for a train, the trainline monitor system having a master node interconnected to at least one other node via a train bus, the train having a head car carrying the master node, and at least one other car carrying the at least one other node and carrying an intelligent subsystem unit including at least one of a heating unit, an air conditioning unit, a ventilation unit and a lighting unit, the intelligent subsystem unit being coupled to the train bus by the at least one other node, the apparatus comprising;

a console, coupled to the master node, having a switch for keying off the train with the master node;

shutdown signal output means in the master node coupled to said console for outputting to the at least one other node via the train bus, after a delay of a predetermined amount of time, a shutdown signal in response to keying off said console, the train being a in a layup mode during the predetermined amount of time wherein the train is not operational but the auxiliary systems controlled by the intelligent subsystem unit of the train are kept running; and shutting down means in the at least one other node, coupled to said shutdown signal output means via the train bus and to the intelligent subsystem unit, for receiving the shutdown signal and for shutting down power to the intelligent subsystem unit in dependence on the shutdown signal.

6. A method for placing a multi-car train in an energy saving layup mode in which selected subsystems of each car of the train remain powered-up while other subsystems of each car are powered off, the train having a communication network which includes a communications node on each car of the train, a vehicle bus on each car of the train coupled to the respective subsystems on the car and to the communications node of the car, and a train bus running through the train interconnecting the communications node and communicating with the vehicle buses by way of the communication nodes, the method comprising:

transmitting a layup mode message over the communication network from one of the nodes to other of the nodes instructing the other of the nodes to maintain power for a predetermined period of time to the selected subsystems of each car of the train and to disconnect power from the other subsystems of each car of the train to thereby place the train in a layup mode.

7. A method as defined in claim 6, wherein the communications network comprises a master/slave communications network in which the one node constitutes a first master node and each other node in each other car of the train constitutes a slave node responsive to the master node, said method further comprising:

when a further car containing a second master node able to control any slave node in any car is coupled to the train during the predetermined time that the train is in the layup mode, forming a resultant train by establishing communication between the second master node and the master/slave communications network; and relinquishing control of any and all slave nodes from the first master node to the second master node.

* * * * *